US010689875B2

(12) United States Patent
Maier et al.

(10) Patent No.: US 10,689,875 B2
(45) Date of Patent: Jun. 23, 2020

(54) METHOD AND DEVICE FOR OPERATING A PARKING LOT

(71) Applicant: Robert Bosch GmbH, Stuttgart (DE)

(72) Inventors: Manuel Maier, Esslingen (DE); Rolf Nicodemus, Bietigheim-Bissingen (DE); Stefan Nordbruch, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 216 days.

(21) Appl. No.: 15/757,232

(22) PCT Filed: Jul. 20, 2016

(86) PCT No.: PCT/EP2016/067276

§ 371 (c)(1),
(2) Date: Mar. 2, 2018

(87) PCT Pub. No.: WO2017/041948

PCT Pub. Date: Mar. 16, 2017

(65) Prior Publication Data

US 2018/0258663 A1 Sep. 13, 2018

(30) Foreign Application Priority Data

Sep. 9, 2015 (DE) ..... 10 2015 217 174

(51) Int. Cl.

| | |
|---|---|
| ***G06F 7/00*** | (2006.01) |
| ***E04H 6/42*** | (2006.01) |
| ***E04H 6/18*** | (2006.01) |

(52) U.S. Cl.

CPC ..... *E04H 6/424* (2013.01); *E04H 6/188* (2013.01); *E04H 6/422* (2013.01)

(58) Field of Classification Search

None

See application file for complete search history.

(56) References Cited

U.S. PATENT DOCUMENTS

2010/0156672 A1 6/2010 Yoo et al.
2011/0274523 A1 11/2011 Petalas
(Continued)

FOREIGN PATENT DOCUMENTS

CN 2297506 Y 11/1998
CN 1217412 A 5/1999
(Continued)

OTHER PUBLICATIONS

International Search Report dated Oct. 11, 2016, of the corresponding International Application PCT/EP2016/067276 filed Jul. 20, 2016.

*Primary Examiner* — Yolanda R Cumbess

(74) *Attorney, Agent, or Firm* — Norton Rose Fulbright US LLP; Gerard Messina

(57) ABSTRACT

A method for operating a parking lot, which has a first parking area section for parking a motor vehicle, which is adjustable in its height with the aid of a hoisting system and which is able to be shifted by the hoisting system from a first position, in which a motor vehicle is able to enter the first parking area section, to a second position, and when the first parking area section is in the second position, a second parking area section for parking a motor vehicle becomes available underneath the first parking area section. The method includes executing an automatic parking operation for a motor vehicle to be parked in the parking lot; and controlling an operation of the hoisting system as a function of execution of the automatic parking operation. In addition, a device for operating a parking lot, a parking lot, and a computer program are described.

18 Claims, 2 Drawing Sheets

(56) References Cited

U.S. PATENT DOCUMENTS

| | | | | |
|---|---|---|---|---|
| 2013/0078062 | A1* | 3/2013 | Artamonov | E04H 6/183<br>414/227 |
| 2013/0085596 | A1* | 4/2013 | Shani | E04H 6/285<br>700/217 |

FOREIGN PATENT DOCUMENTS

| | | | |
|---|---|---|---|
| CN | 101165294 | A | 4/2008 |
| CN | 101980916 | A | 2/2011 |
| CN | 104245465 | A | 12/2014 |
| CN | 104732803 | A | 6/2015 |
| DE | 102012025317 | A1 | 6/2014 |
| DE | 102012222562 | A1 | 6/2014 |
| DE | 102014201797 | A1 | 8/2015 |
| EP | 717163 | A1 | 6/1996 |
| FR | 2456193 | A1 | 12/1980 |
| FR | 2681893 | A1 | 4/1993 |
| JP | H0194168 | A | 4/1989 |
| JP | H10238153 | A | 9/1998 |
| JP | 2007170004 | A | 7/2007 |
| JP | 2011089354 | | 5/2011 |

* cited by examiner

METHOD AND DEVICE FOR OPERATING A PARKING LOT

FIELD

The present invention relates to a method and a device for operating a parking lot. In addition, the present invention relates to a parking lot and to a computer program.

BACKGROUND INFORMATION

German Patent Application No. DE 10 2012 222 562 A1 describes a system for managed parking areas for transferring a vehicle from a starting position to a target position.

In the framework of an automatic parking operation, a vehicle usually parks inside the parking lot automatically and without manual guidance on the part of its driver.

Known in addition are what is referred to as multi-parking lots, in which case two motor vehicles are able to park on top of one another.

SUMMARY

An object of the present invention is to provide for the efficient operation of a parking lot.

Advantageous developments and refinements of the present invention are described herein.

According to one aspect, a method is provided for operating a parking lot that has a first parking area section for parking a motor vehicle, the first parking area section being adjustable in its height by a hoisting system. With the aid of the hoisting system, the first parking area section is able to be shifted from a first position, in which a motor vehicle is able to enter the first parking area section, to a second position. When the first parking area section is in the second position, a second parking area section for parking a motor vehicle is made available underneath the first parking area section. The method includes the following steps:

- Carrying out an automatic parking operation for a motor vehicle to be parked inside the parking lot; and
- Controlling an operation of the hoisting system as a function of the execution of the automatic parking operation.

According to another aspect, a device is provided for operating a parking lot. The parking lot has a first parking area section for parking a motor vehicle, which is adjustable in its height with the aid of a hoisting system. The hoisting system is able to shift the first parking area section from a first position, in which a motor vehicle is able to enter the first parking area section, to a second position. When the first parking area section is in the second position, a second parking area section for parking a motor vehicle becomes available underneath the first parking area section. The device includes:

- An execution device for executing an automatic parking operation for a motor vehicle to be parked inside the parking lot, and
- A control unit for controlling an operation of the hoisting system as a function of the execution of the automatic parking operation.

According to one further aspect, a parking lot for motor vehicles is provided, which includes a first parking area section for parking a motor vehicle that is adjustable in its height with the aid of a hoisting system. A hoisting system is able to shift the first parking area section from a first position, in which a motor vehicle is able to enter the first parking area section, to a second position. When the first parking area section is in the second position, a second parking area section for parking a motor vehicle is made available underneath the first parking area section. The parking lot encompasses the device according to the present invention.

According to another aspect, a computer program is provided, which includes program code for executing the method according to the present invention when the computer program is running on a computer.

As a result, the present invention, in particular and among other things, encompasses combining the advantages that are derived from executing an automatic parking operation with the advantages derived from the existence of a first parking area section that is able to be adjusted in its height with the aid of a hoisting system. This advantageously allows for an efficient operation of the parking lot when a parking operation for a motor vehicle to be parked inside the parking lot is carried out in an automated manner. Mistakes that human drivers could make while manually parking the motor vehicle in the parking lot are thereby able to be avoided in an advantageous manner. Such mistakes, for example, could lead to interruptions in the operation of the parking lot and may cause the motor vehicle to be parked to block or interfere with other motor vehicles during their respective parking operations, for instance.

Providing a height-adjustable first parking area section, which is able to be shifted from a first position to a second position with the aid of a hoisting system, as previously described, offers the particular technical advantage of allowing the parking lot to be utilized in an efficient manner to the effect that two motor vehicles are able to park on top of one another in the three-dimensional space. Firstly, a motor vehicle is able to park in the first parking area section. Secondly, another motor vehicle may park in the second parking area section when the first parking area section has been shifted to the first position. A capacity for parked motor vehicles in the parking lot is advantageously able to be increased in this manner.

In the present invention, an operation of the hoisting system as a function of the execution of the automatic parking operation provides the synergetic advantage of allowing for a particularly efficient operation of the hoisting system in a manner that is adapted to the automatic parking operation. For example, it may be provided that the hoisting system shifts the parking area section from the second to the first position so that the motor vehicle to be parked is able to enter the first parking area section right away, i.e., immediately after its arrival in the first parking area section. Thus, no time is lost in comparison with a scenario in which a driver manually drives the vehicle to the first parking area section, where he must first get out of the motor vehicle in order to manually operate the hoisting system so as to shift the first parking area section to the first position.

In general and more specifically, this yields the technical advantage of allowing for an efficient operation of the parking lot.

Vehicles within the sense of the present invention are motor vehicles.

The wording "respectively" in particular includes the wording "and/or".

In one specific embodiment, the device and the parking lot respectively include the hoisting system.

According to one specific embodiment, the automatic guidance or driving without a driver includes autonomous driving of the motor vehicle.

According to one specific embodiment, the automatic guidance without a driver includes a remote control of the motor vehicle.

According to one specific embodiment, the automatic guidance or driving without a driver includes a remote control of the motor vehicle for part of the way and autonomous driving for a further part of the way.

According to one specific embodiment, the guidance or driving of the motor vehicle without a driver includes a transmission of driving data to the motor vehicle by way of a communications network, on the basis of which the motor vehicle is able to drive in an autonomous manner. For example, such driving data include the following data: setpoint-trajectory data of a setpoint trajectory that the vehicle is to follow, positional data pertaining to a target position that the motor vehicle is to reach, corrective trajectory data of a correction trajectory that the vehicle is to travel in order to return to its setpoint trajectory.

According to one specific embodiment, the control without a driver therefore includes a remote control of the motor vehicle. According to one specific embodiment, a remote control of the motor vehicle encompasses the transmission of remote-control commands to the motor vehicle via a communications network.

According to one specific embodiment, the communications network includes a WLAN communications network and/or a mobile telephony network and/or a LoRa communications network, "LoRa" standing for "low power wide-range communication". A LoRa communications network thus denotes a communications network that operates according to the LoRa standard.

According to one specific embodiment, a communication via the communications network is encrypted.

In particular, a control or driving without a driver is therefore characterized by the fact that there is no longer any need for the presence of a human driver in the motor vehicle for driving or guiding the vehicle.

In particular, a guidance of the motor vehicle includes a control or a regulation of a transverse and/or longitudinal guidance of the motor vehicle.

A parking lot within the sense of the present invention serves as a parking area for motor vehicles. Thus, the parking lot particularly represents a cohesive area that has a plurality of parking spaces (in the case of a parking lot on private property) or parking slots (in the case of a parking lot on public property). The parking spaces or parking slots are therefore parking areas that are also referred to as parking positions for the sake of simplicity. According to one specific embodiment, the parking lot is developed as a parking building, and according to another specific embodiment, it is developed as a parking garage.

According to another specific embodiment, an environment of the hoisting system is sensed with the aid of an environment-sensor system of the parking lot in order to ascertain environmental data corresponding to the sensed environment. On the basis of the environmental data, it is detected whether, and if so, at which distance from the hoisting system, a road user is located within the sensed environment, and the control includes an operation of the hoisting system only when the ascertained distance is greater than or equal to a predefined minimum distance.

This provides the particular technical advantage of increasing the safety of the road user in an efficient manner because it will then be possible to maintain a minimum distance between the hoisting system and the road user at all times while the hoisting system is in operation.

In other words, the ascertained distance is compared to the predefined minimum distance, and the hoisting system is operated as a function of the comparison.

According to one further specific embodiment, the execution of the automatic parking operation includes the automatic guidance of the motor vehicle to be parked to one of the two parking area sections for the purpose of parking it there without a driver. The hoisting system is controlled in such a way that it shifts the height-adjustable parking area section to the corresponding position so that, once the shift has taken place, the motor vehicle is automatically driven to one of the two parking area sections without a driver.

This provides the particular technical advantage of allowing for an efficient parking of the motor vehicle in one of the two parking area sections. More specifically, it is provided that the automatic parking operation and the operation of the hoisting system are adapted to each other in such a way that the height-adjustable parking area section has already been shifted to the corresponding position by the hoisting system so that, after the shift and immediately upon its arrival in the parking area section, the motor vehicle is driven to one of the two parking area sections without a driver.

For example, this is accomplished by adapting a vehicle velocity of the motor vehicle to be parked in such a way that the hoisting system has enough time for shifting the first height-adjustable parking area section to the appropriate position.

For example, this is done by adapting an instant at which the hoisting system is to start the shifting operation to the vehicle velocity of the motor vehicle to be parked.

According to one specific embodiment, the execution of the automatic parking operation includes the automatic guidance of the motor vehicle to be parked to the first parking area section without a driver in order to park the motor vehicle there in an automatic manner. In the event that the second parking area section is occupied by another motor vehicle, the other motor vehicle is automatically driven out of the second parking area section without a driver in order to free up the second parking area section. The hoisting system is controlled in such a way that it shifts the height-adjustable first parking area section to the first position, so that the motor vehicle is automatically driven to the first parking area section, where it is automatically parked without a driver. After the automatic parking of the motor vehicle in the first parking area section, the hoisting system is controlled in such a way that it shifts the height-adjustable first parking area section to the second position, which allows the other motor vehicle to be automatically driven to the second parking area section and parked there without a driver.

This provides the particular technical advantage of allowing the first parking area section to be efficiently utilized for parking purposes even when the second parking area section lying underneath is already occupied. If the motor vehicles had to be controlled in a manual manner, a parking lot employee would first have to walk up to the motor vehicle, which is parked in the second parking area section, in order to manually remove it from the second parking area section. Only then will the parking lot employee be able to shift the first parking area section from the second to the first position with the aid of the hoisting system, in order to then drive the motor vehicle to be parked to the first parking area section. The parking lot employee would then have to get out of the motor vehicle and shift the first parking area section back to the second position with the aid of the hoisting system to then manually return the unparked motor vehicle to the second parking area section. These manual operations require time and are usually not very efficient. However, these disadvantages are able to be overcome in an advantageous and efficient manner with the aid of the present invention, thereby advantageously ensuring an efficient operation of the parking lot.

If the motor vehicle to be parked is parked in the first parking area section, which is disposed in the second position, and if another motor vehicle is parked in the second parking area section, the execution of the automatic parking operation according to one further specific embodiment includes an automatic unparking of the motor vehicle parked in the first parking area section and an automatic guidance of the parked motor vehicle to a target position without a driver. This is accomplished by first driving the other motor vehicle out of the second parking area section in an automatic manner without a driver in order to open up the second parking area section, and the hoisting system is controlled in such a way that it shifts the height-adjustable first parking area section to the first position so that the parked vehicle is automatically driven out of the first parking area section and automatically guided to the target position without a driver. Once the motor vehicle has been automatically driven out of the first parking area section, the hoisting system is controlled in such a way that it shifts the height-adjustable first parking area section to the second position so that the further motor vehicle is automatically driven to the second parking area section and parked there without a driver, or the further motor vehicle is automatically guided to the first parking area section without a driver after the motor vehicle has been automatically driven away.

This achieves the particular technical advantage of allowing for an efficient unparking of the motor vehicle. In particular, this is even possible if another motor vehicle is parked in the second parking area section underneath the motor vehicle. Here, too, parking lot personnel would otherwise have to manually carry out these operations, which requires time and is inefficient, as previously described. As a result, the particular technical advantage of ensuring an efficient operation of the parking lot is obtained.

According to another specific embodiment, the further motor vehicle is automatically parked in a third parking area section during the shifting operation of the hoisting system for parking the motor vehicle in the first parking area section or for driving it out of the first parking area section, so that the traffic lane that extends in front of the second parking area section is not blocked.

This has the particular technical advantage that the further motor vehicle no longer blocks a traffic lane or possibly interferes with vehicular traffic in this traffic lane while the further motor vehicle is waiting for its return to the first or the second parking area section.

In one specific embodiment, one or more of the aforementioned method step(s) is/are documented.

This offers the particular technical advantage that the execution of the present method is also able to be at least partly, and especially completely, reconstructed at a later point in time.

According to one specific embodiment, the device for operating a parking lot is developed or set up to carry out or implement the present method for operating a parking lot. Technical functionalities of the device similarly result from corresponding technical functionalities of the method, and vice versa.

According to one specific embodiment, an ascertainment device is provided, which uses the environmental data that corresponds to an environment of the hoisting system and is sensed with the aid of an environment sensor system as the basis for ascertaining whether, and if so, at which distance from the hoisting system, a road user is located within the sensed environment. The control unit is developed to operate the hoisting system only when the ascertained distance is greater than or equal to a predefined minimum distance.

In another specific embodiment, the execution device is developed to automatically guide the motor vehicle to be parked to one of the two parking area sections without a driver in order to automatically park the motor vehicle in one of the two parking area sections. The control unit is developed to control the hoisting system in such a way that the hoisting system shifts the height-adjustable first parking area section to the respective position, and the execution device is designed to automatically drive the motor vehicle to one of the two parking area sections without a driver after the shift has taken place.

According to one specific embodiment, the execution device is designed to automatically guide the motor vehicle to be parked to the first parking area section without a driver in order to automatically park the vehicle there. If the second parking area section is occupied by a further motor vehicle, the execution device is designed to automatically drive the further vehicle out of the second parking area section without a driver in order to make the second parking area section available. The control unit is designed to control the hoisting system such that the hoisting system shifts the height-adjustable first parking area section to the first position, while the execution device is designed to automatically drive the motor vehicle to the first parking area section and to automatically park the motor vehicle there without a driver once the first parking area section has been shifted to the first position. After the automatic parking of the motor vehicle in the first parking area section, the control unit is designed to control the hoisting system in such a way that the hoisting system shifts the height-adjustable first parking area section to the second position. The execution device is designed to automatically drive the further motor vehicle to the second parking area section without a driver and to automatically park it there after the first parking area section has been shifted to the second position.

According to one further specific embodiment, when the motor vehicle to be parked is parked in the first parking area section, which is in the second position, and when a further motor vehicle parks in the second parking area section, the execution device is designed to automatically unpark the motor vehicle that is parked in the first parking area section and to automatically guide it to a target position without a driver. The execution device is designed to first drive the further motor vehicle out of the second parking area section in an automatic manner and without a driver in order to make the second parking area section available. The control unit is designed to control the hoisting system in such a way that the hoisting system shifts the height-adjustable first parking area section to the first position, while the execution device is designed to automatically drive the parked motor vehicle out of the first parking area section and to automatically guide it to the target position without a driver. The control unit is designed to control the hoisting system to the effect that, once the motor vehicle has been automatically driven out of the first parking area section, the hoisting system shifts the height-adjustable first parking area section to the second position. The execution device is designed to drive the further vehicle to the second parking area section and to park it there in an automatic manner and without a driver, and the execution device is designed to automatically guide the further motor vehicle to the first parking area section without a driver after the motor vehicle has been automatically driven out.

In another specific embodiment, the execution device is designed to temporarily park the further motor vehicle in a third parking area section in an automatic manner during the shifting of the hoisting system for parking the motor vehicle in the first parking area section or for driving it out of the first parking area section, so that a traffic lane that extends in front of the second parking area section will not be blocked.

In another specific embodiment, a documentation device is provided for documenting one or more of the aforementioned method step(s).

According to one specific embodiment, the method for operating a parking lot is carried out or implemented with the aid of the device for operating a parking lot.

According to one specific embodiment, the hoisting system is a hydraulic hoisting system.

According to one specific embodiment, an environment sensor system is provided for sensing an environment of the hoisting system.

According to one specific embodiment, the environment sensor system includes one or more environmental sensor(s). An environmental sensor, for example, is one of the following environmental sensors: an infrared sensor, an ultrasonic sensor, a laser sensor, a lidar sensor, a solenoid sensor, a radar sensor and a video sensor.

In all instances, driving or guiding the motor vehicle or the further motor vehicle refers to driving without a driver or a guidance without a driver.

According to one specific embodiment, a communications interface is provided, which is designed to transmit control commands to the hoisting system via a communications network.

According to one further specific embodiment, the control unit is designed to ascertain control commands for the hoisting system.

In one further specific embodiment, the execution device includes a remote-control unit for the remote control of the motor vehicle.

According to one specific embodiment, the execution device ascertains driving data as described earlier.

According to one specific embodiment, the communications interface is designed to transmit the ascertained driving data to the motor vehicle via a communications network.

In one specific embodiment, the second parking area section is developed to be adjustable in its height via the hoisting system. With the aid of the hoisting system, the second parking area section is able to be shifted from a first position, in which a motor vehicle is able to enter the second parking area section, to a second position. When the second parking area section is in the second position, at least one third parking area section for parking a motor vehicle is located underneath the second parking area section.

This has the particular technical advantage of allowing for a further increase in the capacity of the parking lot. An area available to motor vehicles for parking purposes is therefore able to be utilized in an advantageous and efficient manner.

The wording "at least one third parking area section" is representative of additional specific embodiments, in which the third parking area section is adjustable in its height with the aid of the hoisting system, in a similar manner as the first and the second parking area sections. When the third parking area section is in the second position, a fourth parking area section for parking a motor vehicle is situated underneath the third parking area section.

This principle may be continued at will, so that in one specific embodiment a multitude of superposed parking area sections is provided, which are adjustable in height with the aid of the hoisting system. Generally, this principle is limited by the available installation space.

According to one specific embodiment, the height-adjustable parking area sections are adjusted in their heights with the aid of the hoisting system as a function of the execution of the automatic parking operation.

Below, the present invention is described in greater detail on the basis of preferred exemplary embodiments.

DETAILED DESCRIPTION OF EXAMPLE EMBODIMENTS

Figure 1:
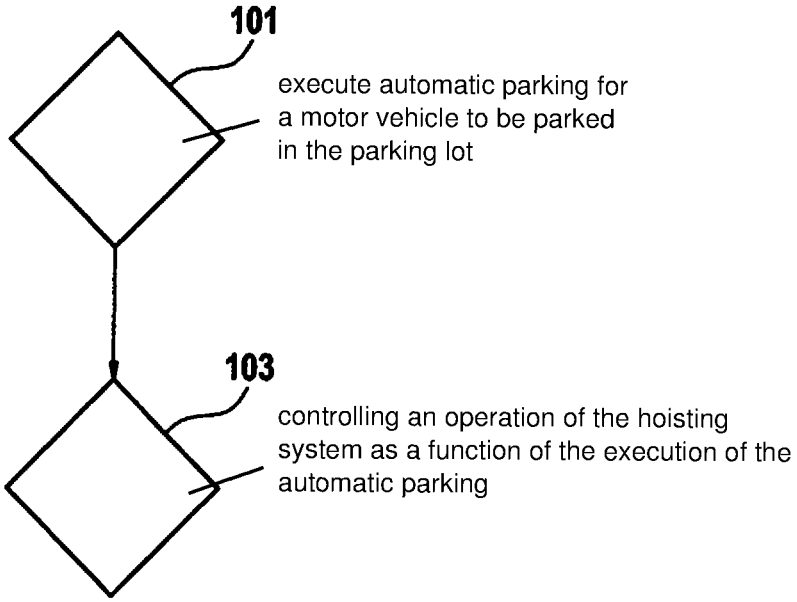
FIG. 1 shows a flow diagram of a method for operating a parking lot.

FIG. 1 shows a flow diagram of a method for operating a parking lot. The parking lot has a first parking area section for parking a motor vehicle, which is adjustable in its height by a hoisting system and is able to be shifted from a first position, in which a motor vehicle is able to enter the first parking area section, to a second position with the aid of the hoisting system. When the first parking area section is in the second position, a second parking area section for parking a motor vehicle is opened up underneath the first parking area section.

The present method includes the following steps:

Executing 101 an automatic parking operation for a motor vehicle to be parked in the parking lot, and Controlling 103 an operation of the hoisting system as a function of the execution of the automatic parking operation.

For example, the execution of the automatic parking operation includes an automatic guidance of the motor vehicle to be parked without a driver, from a drop-off position, where a driver of the motor vehicle has parked his or her vehicle for the execution of the automatic parking operation, to the first or the second parking area section. The automatic parking operation, for example, includes that the motor vehicle to be parked is parked in the first or the second parking area section. In particular, the automatic parking operation includes the automatic guidance of the motor vehicle parked in the respective first or second parking area section from the corresponding parking area section to a target position without a driver. A target position, for example, is a pick-up position, where a person is able to take possession of the motor vehicle. In other words, the motor vehicle is parked at the target position in an automatic manner without a driver.

For instance, the target position is identical with the drop-off position, or it may differ from the drop-off position.

Figure 2:
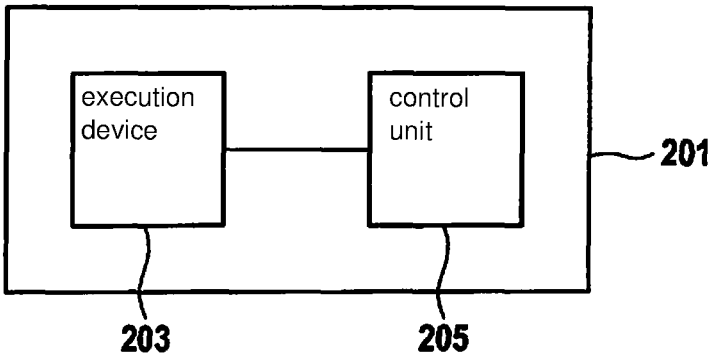
FIG. 2 shows a device for operating a parking lot.

FIG. 2 shows a device 201 for operating a parking lot. The parking lot has a first parking area section for parking a motor vehicle, which is adjustable in its height with the aid of a hoisting system. Using the hoisting system, the first parking area section is able to be shifted from a first position, in which a motor vehicle is able to enter the first parking area section, to a second position. When the first parking area section is in the second position, a second parking area section for parking a motor vehicle is exposed underneath the first parking area section.

Device 201 includes:

an execution device 203 for executing an automatic parking operation for a motor vehicle to be parked in the parking lot, and a control unit 205 for controlling an operation of the hoisting system as a function of the execution of the automatic parking operation.

According to one specific embodiment, device 201 includes a communications interface, which is designed to transmit driving data and/or remote-control commands via a communications network to the motor vehicle in order to guide the motor vehicle without the presence of a driver.

According to one specific embodiment, device 201 includes a communications interface, which is designed to transmit control commands for controlling the operation of the hoisting system via a communications network to the hoisting system.

According to one specific embodiment, the first and/or the second parking area section include(s) a parking-occupancy sensor in each case. The parking-occupancy sensor in particular is designed to detect an occupancy status of the respective parking area section.

Based on the detected occupancy status, one specific embodiment provides for the execution of the automatic parking operation.

According to one specific embodiment, the parking-occupancy sensor is one of the following environmental sensors: a radar sensor, a lidar sensor, a laser sensor, an ultrasonic sensor, a solenoid sensor, a video sensor or an infrared sensor.

In one specific embodiment, device 201 encompasses the hoisting system.

Figure 3:
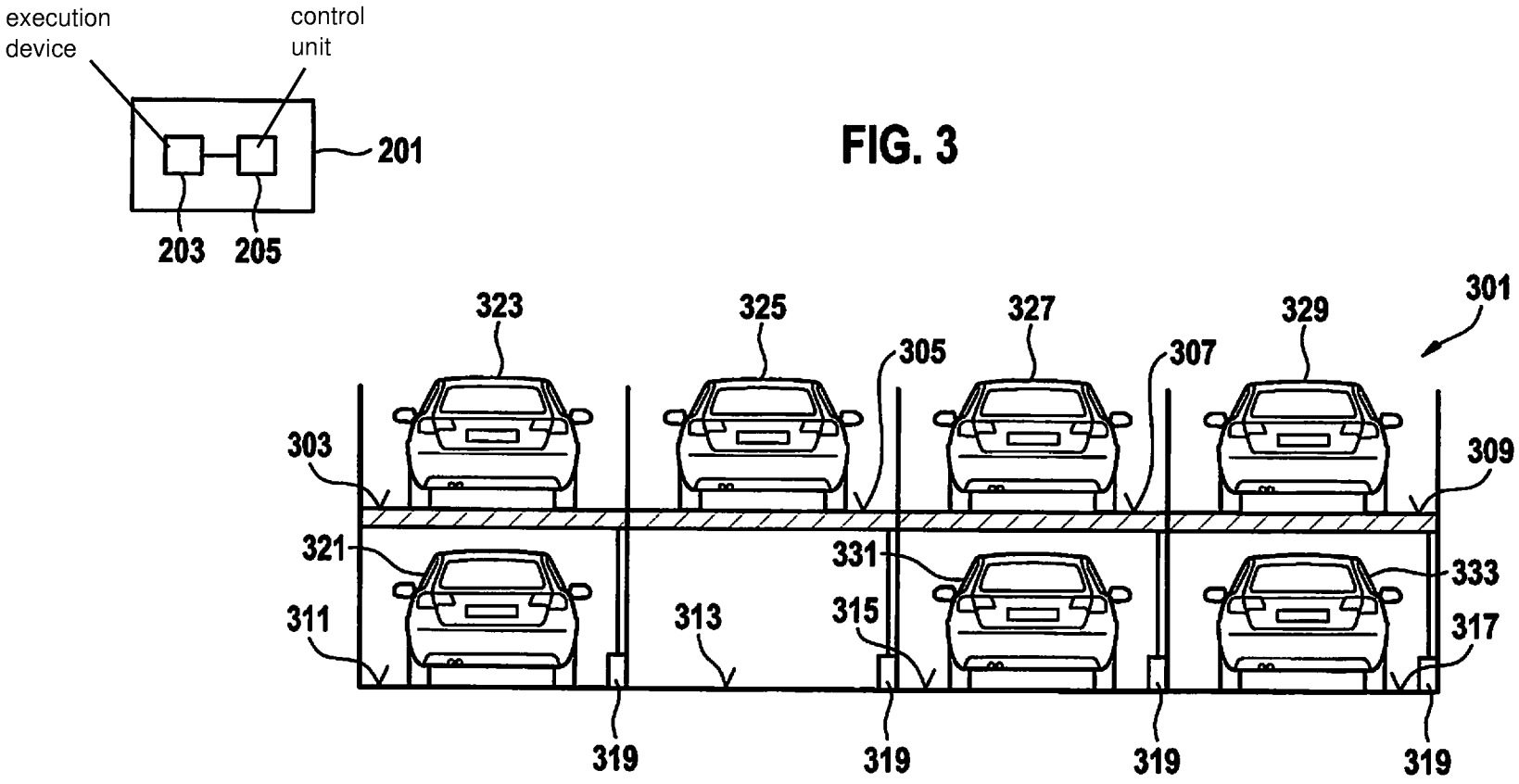
FIG. 3 shows a parking lot.

FIG. 3 shows a parking lot 301 for motor vehicles.

Parking lot 301 includes device 201 from FIG. 2.

In addition, parking lot 301 includes four height-adjustable first parking area sections 303, 305, 307, 309. The four height-adjustable first parking area sections 303, 305, 307, 309 are adjustable in their height with the aid of a respective hoisting system 319, i.e. from a first position to a second position or from a second position to a first position.

According to the illustration depicted in FIG. 3, four first parking area sections 303, 305, 307, 309 are shifted to the second position.

Developed underneath the four first parking area sections 303, 305, 307, 309 is a respective second parking area section 311, 313, 315, 317, which has now been opened up because the associated first parking area sections 303, 305, 307, 309 are in the second position.

The first position of the four first parking area sections 303, 305, 307, 309 describes a position in which a motor vehicle is able to enter parking area sections 303, 305, 307, 309. As a rule, this is a position at ground level.

Motor vehicles 323, 325, 327, 329 are parked in the four first parking area sections 303, 305, 307, 309.

Motor vehicles 321, 331, 333 are parked in second parking area sections 311, 315, 317.

In other words, second parking area section 313 is not occupied.

Within the framework of an automatic parking operation, for instance, a person would like to take possession of motor vehicle 323, which is parked in first parking area section 303. For example, this person requests his motor vehicle 323 from a parking lot management system of parking lot 301 via a communications system. The parking lot management system then coordinates and/or controls a respective return of motor vehicle 323 with the aid of device 201, so that the user is able to resume control of his motor vehicle 323. For example, motor vehicle 323 is guided from first parking area section 303 to a pickup position without a driver, where the person is able to take possession of motor vehicle 323 again.

For this purpose, motor vehicle 321, which is parked in second parking area section 311 located underneath first parking area section 303, is first unparked and, for example, is automatically guided to second parking area section 313 without a driver and parked there. This unparking operation thus opens up second parking area section 311 so that hoisting system 319 is able to shift first parking area section 303 to the first position, which then advantageously allows motor vehicle 323 to leave first parking area section 303.

Once motor vehicle 323 has been unparked and is en route to its pickup position, it is provided, for instance, that motor vehicle 321, which had been parked in second parking area section 313 in the interim, is guided back to second parking area section 311, or that motor vehicle 321 remains parked in second parking area section 313.

If second parking area section 313 is also occupied, one specific embodiment provides that motor vehicle 321 parks in a traffic lane in front of the parking area sections and waits there until the unparking operation of motor vehicle 323 has come to an end; once the unparking operation has been completed, motor vehicle 321 may then drive back to parking area section 311 or it may drive to parking area section 303.

According to one specific embodiment, a check takes place as to whether a first and/or a second parking area section is/are available or occupied.

According to one specific embodiment, an actuation of the hoisting system is provided in order to shift the first height-adjustable parking area section in the appropriate manner.

In one further specific embodiment, a check of the hoisting system is provided with the goal of determining the current position of the hoisting system, i.e., whether the first parking area section is in the first or in the second position.

According to one specific embodiment, an actuation of maneuvering operations for the parking or unparking of one of multiple motor vehicles is provided, in particular within the framework of the automatic parking operation.

According to one specific embodiment, all steps are monitored or checked and, for example, are recorded for safety-related reasons.

The aforementioned steps are carried out with the aid of the parking lot management system, for instance.

According to one specific embodiment, a method step or multiple method steps or all method steps and, in particular, a movement of the hoisting system, in particular driving operations of the motor vehicles, is/are carried out only if no road user, in particular no persons, is/are present in the immediate environment of the hoisting system. In other words, it is checked whether a predefined minimum distance is maintained between the road user and the hoisting system. This is able to be done especially with the aid of infrastructure monitors, e.g., with the aid of an environment sensor system, and may be controlled by the parking lot management system, in particular.

According to one specific embodiment, the entire operation is additionally documented for safety-related reasons and especially for liability purposes.

Among other things, the present invention therefore provides an efficient technical solution that advantageously combines the two system approaches of automated valet parking and multi-parking in order to eliminate possible shortcomings of the respective system approaches, or to at least compensate for such shortcomings. Automated valet parking stands for an automated parking operation and may be abbreviated to AVP. Multi-parking represents the presence of a hoisting system and a first and a second parking area section, as previously described, so that two motor vehicles are able to park on top of one another in a predefined parking area.

For this purpose, a remote control of the hoisting system is carried out, in particular, and/or the hoisting system is designed for such a remote control. For example, the hoisting system includes a communications interface that is able to receive remote-control commands via a communications network.

According to one specific embodiment, the communications network includes the Internet.

In particular an automatic detection is provided in order to ascertain whether a parking area section, e.g., the first or the second parking area section, is occupied or unoccupied, which is accomplished with the aid of parking-occupancy sensors, for instance. 1

In one specific embodiment, an automatic detection as to whether the first parking area section is in the first or the second position is provided, in particular, i.e. whether the hoisting system is located at the bottom (first position) or at the top (second position), or is in motion.

According to one specific embodiment, maneuvering functions are carried out, which are able to be triggered by a parking-lot infrastructure, for example.

According to one specific embodiment, heights or widths of the first or the second parking area sections are taken into account. This may be accomplished on the basis of a digitized parking lot map, for instance.

What is claimed is:

1. A method for operating a parking lot, wherein the parking lot includes a first parking area section and a second parking area section, and a height of the first parking area section is adjustable by a hoisting system shifting the first parking area section between a first position, in which a motor vehicle is able to enter the first parking area section, and a second position, at which the motor vehicle is able to enter the second parking area section underneath the first parking area section, the method comprising:

wirelessly transmitting instructions to an internal drive system of the motor vehicle according to which the internal drive system of the motor vehicle performs an automatic driving operation by which the motor vehicle is driven into the first parking area section or the second parking area section of the parking lot; and controlling an operation of the hoisting system:

(a) to allow the motor vehicle to be driven into the first parking area section or the second parking area section by the automatic parking operation; and/or (b) after the motor vehicle has entered the first parking area section by the automatic parking operation, to shift the first parking area section into the second position, thereby parking the motor vehicle in the first parking area section while the first parking area section is in the second position.

2. The method as recited in claim 1, wherein the automatic driving operation includes an automatic driverless guidance of the motor vehicle by which the motor vehicle enters and is parked in one of the two parking area sections, and the controlling of the hoisting system causes the hoisting system to shift the first parking area section into the first or second position, thereby allowing the motor vehicle to be automatically driven into the one of the two parking area sections without a driver.

3. The method as recited in claim 1, wherein:

the automatic driving operation includes an automatic guidance of the motor vehicle by which the motor vehicle enters and is parked in the first parking area section without a driver due to the second parking area section initially being occupied by a further motor vehicle, the method further comprises controlling the further motor vehicle to be driven out of the second parking area section without a driver, thereby making the second parking area section available;

the controlling the operation of the hoisting system includes the hoisting system being controlled to shift the first parking area section to the first position after the driving out of the further motor vehicle from the second parking area section;

the wirelessly transmitting the instructions is performed to cause the automatic driving operation by which the motor vehicle is automatically driven to and parked in the first parking area section without a driver after the shift of the first parking area section to the first position;

the controlling the operation of the hoisting system further includes the hoisting system being controlled, after the automatic parking of the motor vehicle in the first parking area section, to shift the first parking area section to the second position; and the method further comprises controlling the further motor vehicle, after the shift of the first parking area section to the second position, to be automatically driven to and parked in the second parking area section without a driver.

4. The method as recited in claim 1, further comprising:

after the motor vehicle has been parked and still remains parked in the first parking area section, which is in the second position, and when a further motor vehicle is parked in the second parking area section, automatically unparking the motor vehicle from the first parking area section and into a target position without a driver by:

controlling the further motor vehicle to be driven out of the second parking area section without a driver, thereby making the second parking area section available;

subsequent to the further motor vehicle being driven out of the second parking area section, controlling the hoisting system to shift the first parking area section to the first position;

subsequent to the shift of the first parking area section to the first position, controlling the motor vehicle to be automatically driven out of the first parking area section and to the target position without a driver;

after the motor vehicle has been automatically driven out of the first parking area section, controlling the hoisting system is to shift the first parking area section back to the second position; and after the shift of the first parking area section back to the second position, controlling the further motor vehicle to be automatically driven to the second parking area section and parked there without a driver.

5. The method as recited in claim 4, wherein the controlling of the further motor vehicle to be driven out of the second parking area section is to cause the further motor vehicle to be automatically parked in a third parking area section on a temporary basis in order not to block a traffic lane extending in front of the second parking area section.

6. The method as recited in claim 1, wherein at least one of the method steps is documented.

7. A method comprising:

executing an automatic parking operation for a motor vehicle to be parked in a parking lot; and controlling an operation of a hoisting system as a function of the execution of the automatic parking operation, wherein:

the parking lot includes a first parking area section, a second parking area section, and a third parking area section;

a height of the first parking area section is adjustable by the hoisting system shifting the first parking area section between a first position of the first parking area section, in which the motor vehicle is able to enter the first parking area section, and a second position of the first parking area section, at which the motor vehicle is able to enter the second parking area section underneath the first parking area section; and a height of the second parking area section is adjustable by the hoisting system shifting the second parking are section between a first position of the second area section, in which the motor vehicle is able to enter the second parking area section, and a second position of the second parking area section, at least one at which the motor vehicle is able to enter the third parking area section underneath the second parking area section.

8. A device for operating a parking lot, wherein the parking lot includes a first parking area section and a second parking area section, and a height of the first parking area section is adjustable by a hoisting system shifting the first parking area section between a first position, in which a motor vehicle is able to enter the first parking area section, and a second position, at which the motor vehicle is able to enter the second parking area section underneath the first parking area section, the device comprising:

a control unit; and a wireless transmitter;

wherein the control unit is configured to:

wirelessly transmit, via the wireless transmitter, instructions to an internal drive system of the motor vehicle according to which the internal drive system of the motor vehicle performs an automatic driving operation by which the motor vehicle is driven into the first parking area section or the second parking area section of the parking lot; and control an operation of the hoisting system:

(a) to allow the motor vehicle to be driven into the first parking area section or the second parking area section by the automatic parking operation; and/or (b) after the motor vehicle has entered the first parking area section by the automatic parking operation, to shift the first parking area section into the second position, thereby parking the motor vehicle in the first parking area section while the first parking area section is in the second position.

9. The device as recited in claim 8, wherein the automatic driving operation includes an automatic driverless guidance of the motor vehicle by which the motor vehicle enters an is parked in one of the two parking area sections, and the control of the hoisting system causes the hoisting system to shift the first first parking area section into the first or second position, thereby allowing the motor vehicle to be automatically driven into the one of the two parking area sections without a driver.

10. The device as recited in claim 8, wherein:

the automatic driving operation includes an automatic guidance of the motor vehicle by which the motor vehicle enters and is parked in the first parking area section without a driver due to the second parking area section initially being occupied by a further motor vehicle, the control device is further configured to control the further motor vehicle to be driven out of the second parking area section without a driver, thereby making the second parking area section available;

the control of the operation of the hoisting system includes the hoisting system being controlled to shift the first parking area section to the first position after the driving out of the further motor vehicle from the second parking area section;

the wireless transmission of the instructions is performed to cause the automatic driving operation by which the motor vehicle is automatically park driven to and parked in the first parking area section without a driver after the shift of the first parking area section to the first position; and the control of the operation of the hoisting system further includes the hoisting system being controlled, after the automatic parking of the motor vehicle in the first parking area section, to shift the first parking area section to the second position; and the control device is further configured to control the further motor vehicle, after the shift of the first parking area section to the second position, to be automatically driven to and parked in the second parking area section without a driver.

11. The device as recited in claim 8, wherein, after the motor vehicle has been parked and still remains parked in the first parking area section, which is in the second position, and when a further motor vehicle is parked in the second parking area section, the control device is further configured to automatically unpark the motor vehicle from the first parking area section and into a target position without a driver by:

controlling the further motor vehicle to be driven out of the second parking area section without a driver, thereby making the second parking area section available;

subsequent to the further motor vehicle being driven out of the second parking area section, controlling the hoisting system to shift the first parking area section to the first position;

subsequent to the shift of the first parking area section to the first position, controlling the motor vehicle to be automatically driven out of the first parking area section and to the target position without a driver;

after the motor vehicle has been automatically driven out of the first parking area section, controlling the hoisting system to shift the first parking area section back to the second position; and after the shift of the first parking area section back to the second position, controlling the further motor vehicle to be automatically driven to the second parking area section and parked there without a driver.

12. The device as recited in claim 11, wherein the controlling of the further motor vehicle to be driven out of the second parking area section is to cause the further motor vehicle to be automatically parked in a third parking area section on a temporary basis in order not to block a traffic lane extending in front of the second parking area section.

13. The device as recited in claim 8, wherein a documenting device is provided for documenting at least one of the functions of the device.

14. The device as recited in claim 8, wherein a height of the second parking area section is adjustable by the hoisting system from a first position, in which the motor vehicle is able to enter the second parking area section, to a second position, thereby making a third parking area section available for parking of the motor vehicle in the third parking area section underneath the second parking area section.

15. A device for operating a parking lot, the device comprising a control device, wherein:

the parking lot includes a first parking area section and a second parking area section;

a height of the first parking area section is adjustable by a hoisting system shifting the first parking area section between a first position, in which a motor vehicle is able to enter the first parking area section, and a second position, at which the motor vehicle is able to enter the second parking area section underneath the first parking area section;

the control device is configured to:

ascertain, on the basis of environmental data corresponding to an environment of the hoisting system sensed with the aid of an environment sensor system, that a road user is not located within a predetermined minimum distance from hoisting system in the sensed environment;

execute an automatic parking operation for the motor vehicle to be parked in the parking lot; and operate the hoisting system as a function of the execution of the automatic parking operation; and the operation of the hoisting system is performed conditional upon the ascertainment.

16. A parking lot comprising:

a hoisting system;

a first parking area section;

a second parking area section;

a control unit; and a wireless transmitter;

wherein:

a height of the first parking area section is adjustable by the hoisting system shifting the first parking area section between a first position, in which a motor vehicle is able to enter the first parking area section, and a second position, at which the motor vehicle is able to enter the second parking area section underneath the first parking area section; and the control unit is configured to:

wirelessly transmit, via the wireless transmitter, instructions to an internal drive system of the motor vehicle according to which the internal drive system of the motor vehicle performs an automatic driving operation by which the motor vehicle is driven into the first parking area section or the second parking area section of the parking lot; and control an operation of the hoisting system:

(a) to allow the motor vehicle to be driven into the first parking area section or the second parking area section by the automatic parking operation; and/or (b) after the motor vehicle has entered the first parking area section by the automatic parking operation, to shift the first parking area section into the second position, thereby parking the motor vehicle in the first parking area section while the first parking area section is in the second position.

17. A method for operating a parking lot, wherein the parking lot includes a first parking area section and a second parking area section, and a height of the first parking area section is adjustable by a hoisting system shifting the first parking area section between a first position, in which a motor vehicle is able to enter the first parking area section, to and a second position, at which the motor vehicle is able to enter the second parking area section underneath the first parking area section, the method comprising:

sensing an environment of the hoisting system with the aid of an environment sensor system of the parking lot to ascertain environmental data corresponding to the sensed environment;

ascertaining, on the basis of the environmental data, that a road user is not located within a predefined minimum distance from the hoisting system in the sensed environment;

executing an automatic parking operation for the motor vehicle to be parked in the parking lot; and controlling an operation of the hoisting system as a function of the execution of the automatic parking operation, wherein the controlling is performed conditional upon the ascertainment.

18. A non-transitory computer-readable storage medium on which is stored a computer program including program code that is executable by a processor and that, when executed by the processor, causes the processor to perform a method for operating a parking lot, wherein the parking lot includes a first parking area section and a second parking area section, and a height of the first parking area section is adjustable by a hoisting system shifting the first parking area section between a first position, in which a motor vehicle is able to enter the first parking area section, and a second position, at which the motor vehicle is able to enter the second parking area section underneath the first parking area section, the method comprising:

wirelessly transmitting instructions to an internal drive system of the motor vehicle according to which the internal drive system of the motor vehicle performs an automatic driving operation by which the motor vehicle is driven into the first parking area section or the second parking area section of the parking lot; and controlling an operation of the hoisting system:

(a) to allow the motor vehicle to be driven into the first parking area section or the second parking area section by the automatic parking operation; and/or (b) after the motor vehicle has entered the first parking area section by the automatic parking operation, to shift the first parking area section into the second position, thereby parking the motor vehicle in the first parking area section while the first parking area section is in the second position.

* * * * *